US010644447B2

(12) United States Patent
Nishio et al.

(10) Patent No.: US 10,644,447 B2
(45) Date of Patent: May 5, 2020

(54) CONNECTOR WITH FRONT RETAINER

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shuya Nishio, Mie (JP); Kiyokazu Sakaguchi, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/763,150

(22) PCT Filed: Sep. 7, 2016

(86) PCT No.: PCT/JP2016/076226
§ 371 (c)(1),
(2) Date: Mar. 26, 2018

(87) PCT Pub. No.: WO2017/051703
PCT Pub. Date: Mar. 30, 2017

(65) Prior Publication Data

US 2018/0277992 A1 Sep. 27, 2018

(30) Foreign Application Priority Data

Sep. 24, 2015 (JP) ..... 2015-187039

(51) Int. Cl.
*H01R 13/631* (2006.01)
*H01R 13/502* (2006.01)
(Continued)

(52) U.S. Cl.
CPC ..... *H01R 13/631* (2013.01); *H01R 13/5025* (2013.01); *H01R 24/20* (2013.01);
(Continued)

(58) Field of Classification Search
CPC ..... H01R 13/52; H01R 13/4223; H01R 13/5208; H01R 13/5219; H01R 13/62955;
(Continued)

(56) References Cited

U.S. PATENT DOCUMENTS 5,458,496 A * 10/1995 Itou ..... B60L 11/1818 439/34
5,637,977 A * 6/1997 Saito ..... B60L 11/1818 320/109
(Continued)

FOREIGN PATENT DOCUMENTS

JP 2010-140724 6/2010
JP 2011-171166 9/2011
(Continued)

OTHER PUBLICATIONS

International Search Report dated Dec. 6, 2016.

*Primary Examiner* — Edwin A. Leon
*Assistant Examiner* — Matthew T Dzierzynski
(74) *Attorney, Agent, or Firm* — Gerald E. Hespos; Michael J. Porco; Matthew T. Hespos

(57) ABSTRACT

A connector (10) is connectable to a mating connector (50) including a plurality of resin walls (54) formed to be open forward and having a plurality of mating terminals (60) individually fixed inside the respective resin walls (54). The connector (10) includes a plurality of terminals (40) to be connected to the plurality of mating terminals (60) and a housing (20) having the plurality of terminals (40) accommodated in a movable state inside. The plurality of terminals (40) are connected to the mating terminals (60) while being
(Continued)

respectively positioned by the plurality of resin walls (54) at the time of connection to the mating connector (50).

2 Claims, 9 Drawing Sheets

(51) Int. Cl.

| | |
|---|---|
| ***H01R 24/20*** | (2011.01) |
| ***H01R 13/42*** | (2006.01) |
| ***H01R 13/52*** | (2006.01) |
| ***H01R 13/11*** | (2006.01) |
| ***H01R 13/44*** | (2006.01) |
| ***H01R 13/506*** | (2006.01) |
| ***H01R 13/621*** | (2006.01) |
| ***H01R 13/6581*** | (2011.01) |
| ***H01R 24/28*** | (2011.01) |
| ***H01R 103/00*** | (2006.01) |

(52) U.S. Cl.
CPC ..... *H01R 13/113* (2013.01); *H01R 13/42* (2013.01); *H01R 13/44* (2013.01); *H01R 13/506* (2013.01); *H01R 13/5219* (2013.01); *H01R 13/6215* (2013.01); *H01R 13/6581* (2013.01); *H01R 24/28* (2013.01); *H01R 2103/00* (2013.01)

(58) Field of Classification Search
CPC ..... H01R 13/6581; H01R 13/4364; H01R 13/5202; H01R 13/521; H01R 2103/00; H01R 13/6315
USPC ..... 439/246
See application file for complete search history.

(56) References Cited

U.S. PATENT DOCUMENTS

| | | | | |
|---|---|---|---|---|
| 8,206,171 | B2 * | 6/2012 | Osawa | H01R 13/502 439/352 |
| 8,257,101 | B2 * | 9/2012 | Ichio | H01R 13/4367 439/206 |
| 8,342,856 | B2 * | 1/2013 | Takada | H01R 13/521 439/246 |
| 8,376,778 | B2 * | 2/2013 | Obata | H01R 13/4223 439/595 |
| 8,469,751 | B2 * | 6/2013 | Oiri | H01R 43/22 439/701 |
| 8,562,370 | B2 * | 10/2013 | Takagi | H01R 13/6275 439/345 |
| 9,124,024 | B2 * | 9/2015 | Itsuki | H01R 13/533 |
| 9,343,825 | B2 * | 5/2016 | Kashiwada | H01R 4/38 |
| 9,463,702 | B2 * | 10/2016 | Fukushima | H01R 13/506 |
| 9,469,206 | B1 * | 10/2016 | Lee | B60L 11/1818 |
| 9,793,642 | B2 * | 10/2017 | Natter | H01R 13/506 |
| 9,966,715 | B2 * | 5/2018 | Ishibashi | H01R 13/424 |
| 2004/0266270 | A1 * | 12/2004 | Miyazaki | H01R 4/46 439/660 |
| 2011/0207368 | A1 | 8/2011 | Takada et al. | |
| 2011/0263148 | A1 | 10/2011 | Obata et al. | |
| 2012/0289090 | A1 | 11/2012 | Oiri et al. | |
| 2014/0051286 | A1 | 2/2014 | Itsuki et al. | |
| 2015/0340790 | A1 | 11/2015 | Hamai et al. | |

FOREIGN PATENT DOCUMENTS

| | | |
|---|---|---|
| JP | 2011-228203 | 11/2011 |
| JP | 2012-238534 | 12/2012 |
| JP | 2013-101856 | 5/2013 |
| JP | 2014-38793 | 2/2014 |

* cited by examiner

CONNECTOR WITH FRONT RETAINER

BACKGROUND

Field of the Invention

This specification relates to a connector.

Description of the Related Art

Japanese Unexamined Patent Publication No. 2014-38793 discloses a connector to be mounted on a shield case of a device. A device-side connector that is connectable to the connector is provided inside the shield case. The device-side connector includes a device-side housing holding a plurality of male terminals, and this device-side housing is provided with resin walls surrounding the male terminals. These resin walls have a function of impeding the entrance of fingers to prevent the fingers from touching the male terminals in addition to a function of insulating the male terminals from each other. Thus, the tips of the resin walls are located in front of the tips of the male terminals.

A connection stroke for connecting the connector to the device-side connector can be made smaller by making the resin walls shorter in the above device-side connector. However, a terminal accommodating portion for accommodating female terminals inside then needs to be miniaturized as much as possible and the resin walls to be fit into this terminal accommodating portion need to be miniaturized. However, the terminal accommodating portion is indispensable to accommodate the female terminals in a positioned state and predetermined strength needs to be ensured. Thus, there is a limit to miniaturization. If the terminal accommodating portion is eliminated, the female terminals cannot be positioned, and this may cause a problem in connection to the male terminals.

SUMMARY

A connector disclosed by this specification is connectable to a mating connector. The mating connector has resin walls formed to be open forward and mating terminals are fixed individually fixed inside the respective resin walls. The connector has a housing and terminals are accommodated in a movable state inside the housing. The terminals are connected to the mating terminals while being respectively positioned by the resin walls at the time of connection to the mating connector.

According to this configuration, the terminals are positioned by the resin walls in the mating connector. Thus, the housing does not require a structure for positioning the terminals. As a result, the resin walls position the terminals and also insulate between adjacent terminals. Thus, the housing can be miniaturized and a length of the resin walls of the mating connector in a direction perpendicular to a connecting direction can be shorter. If the length in the direction perpendicular to the connecting direction is shorter, the resin walls can be shorter in the connecting direction and a connection stroke to the mating connector can be smaller.

The housing may include an accommodating portion having an opening that is open forward and that is configured to collectively accommodate the terminals inside. A front retainer is to be mounted at the opening, and the front retainer may include a front wall with insertion holes through which the resin walls are inserted, and a peripheral wall for allowing the front wall to be mounted in a state movable with respect to the accommodating portion. According to this configuration, the resin walls are inserted through the insertion holes to enter the accommodating portion and the terminals are positioned by the resin walls. If the mating connector is deviated in position with predetermined tolerances, a positional deviation can be absorbed by the front wall moving in accordance with the position of the mating connector.

Front end parts of the terminals may be held temporarily by the front wall in a state closing the opening. According to this configuration, the terminals simultaneously move when the front wall moves. Thus, the resin walls that have passed through the insertion holes butt against the terminals.

According to the connector disclosed by this specification, it is possible to make the connection stroke smaller and to miniaturize both the housing and the mating connector.

DETAILED DESCRIPTION

An embodiment is described with reference to FIGS. 1 to 9. A connector 10 of this embodiment is a wire-side connector connected to an end of a wire W and used in a wiring harness for connecting devices, such as a battery and an inverter. On the other hand, a mating connector 50 connectable to the connector 10 is a device-side connector mounted in a case C of a device, such as an inverter or a motor. As shown in FIG. 4, the mating connector 50 is disposed inside the case C and the case C is provided with a mounting hole C1 through which the connector 10 is passed when being connected to the mating connector 50. Further, as shown in FIG. 3, two mounting portions C2 project forward on the outer surface of the case C for mounting the connector 10.

Figure 3:
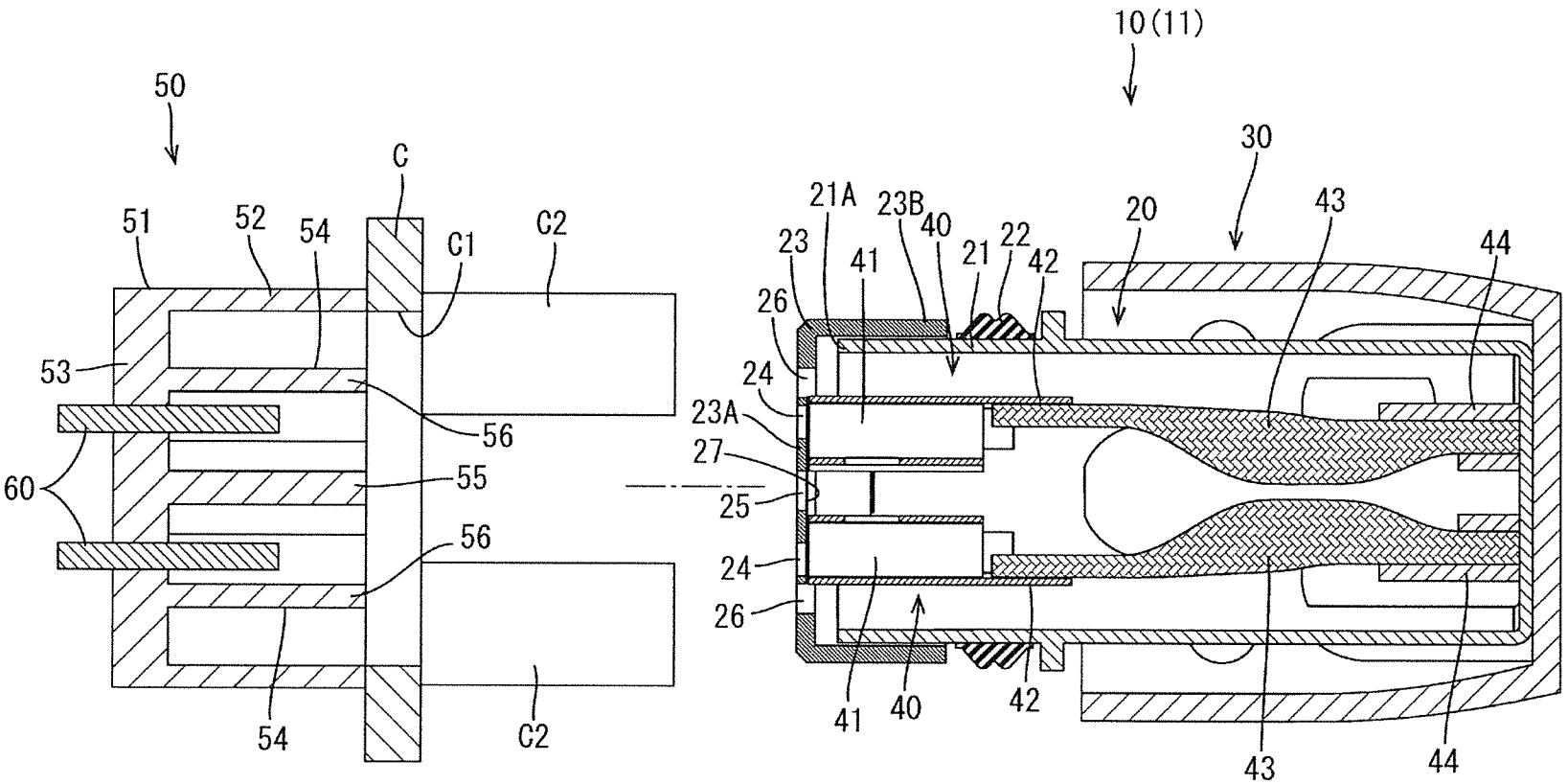
FIG. 3 is a section along A-A in FIG. 1.
Figure 4:
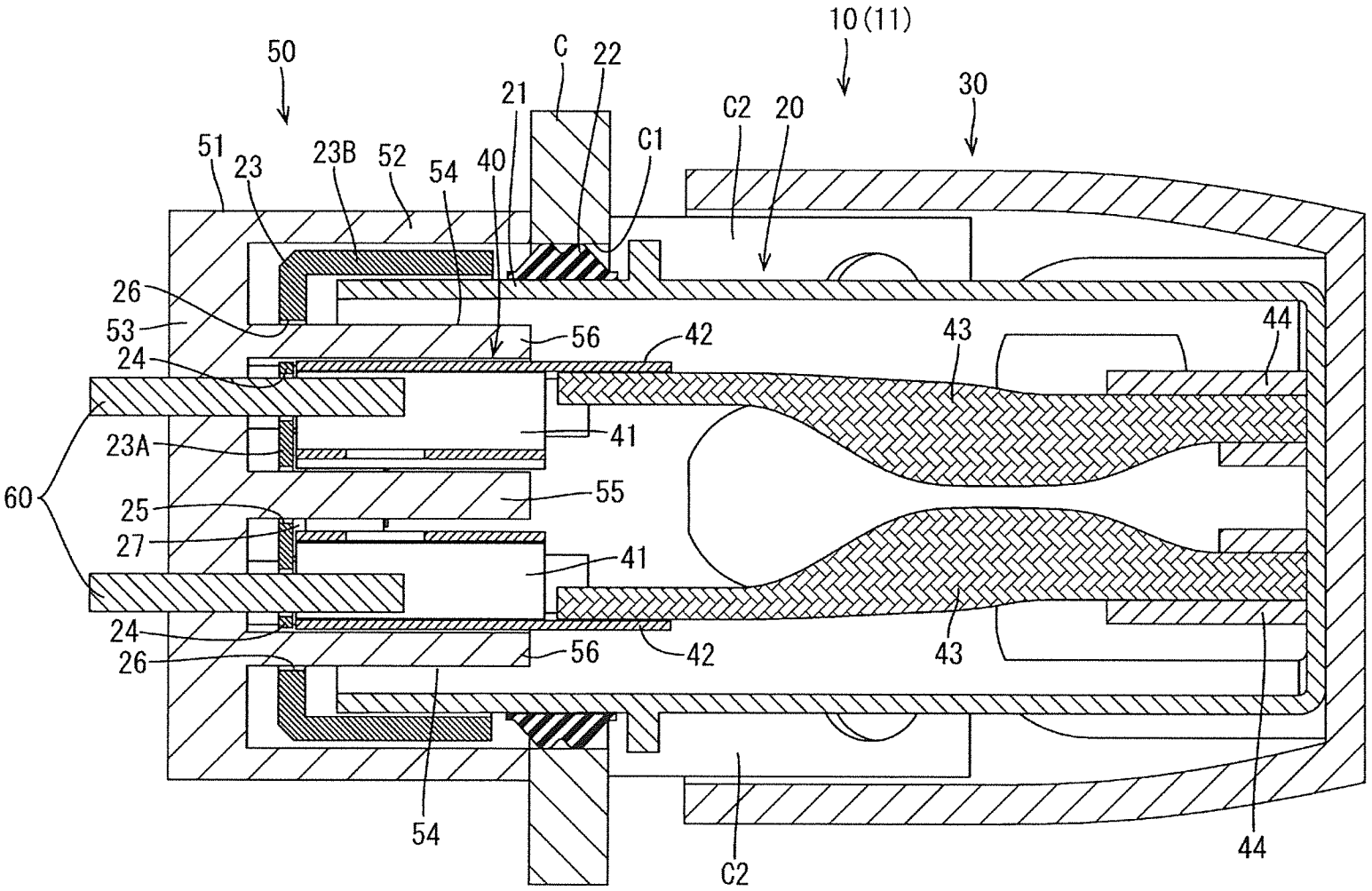
FIG. 4 is a section along B-B in FIG. 2.
Figure 6:
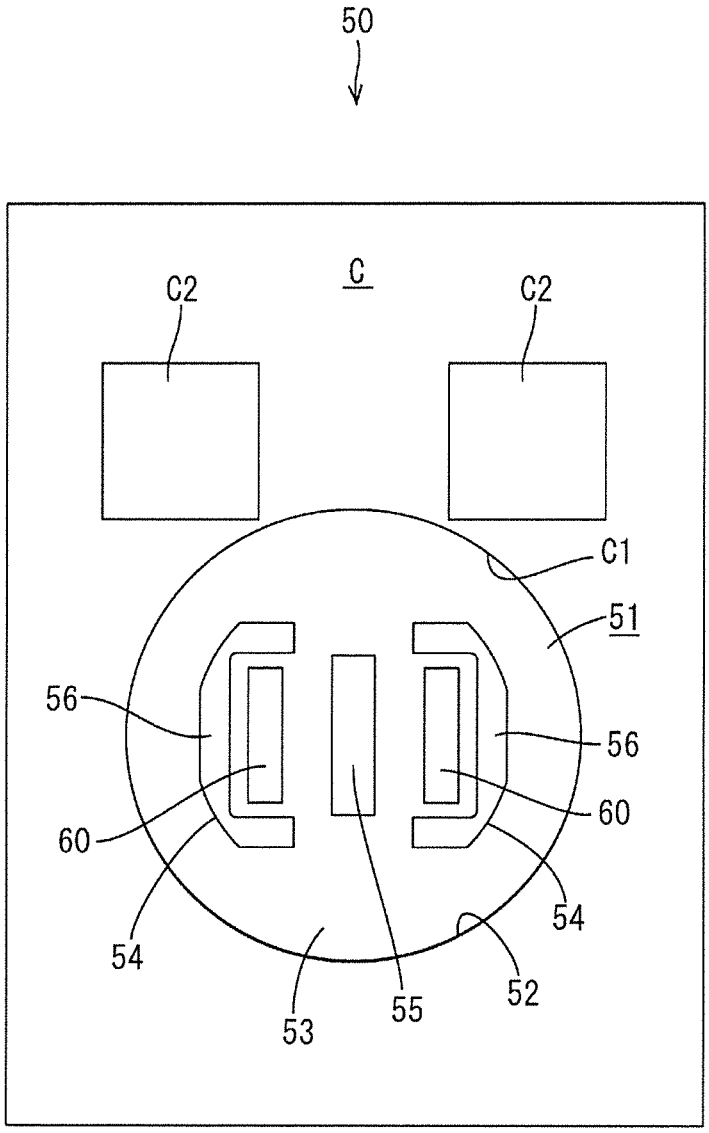
FIG. 6 is a front view of the mating connector.

As shown in FIGS. 3 and 6, the mating connector 50 includes a mating housing 51 into which the connector 10 is fit. The mating housing 51 is made of synthetic resin and includes a tubular portion 52 having a forwardly open hollow tubular shape and resin walls 54 project forward from a back wall 53 of the tubular portion 52. Further, the mating connector 50 includes mating terminals 60 insert-molded in the mating connector 51 while penetrating through the back wall 53 of the tubular portion 52. The mating terminal 60 is a busbar terminal in the form of a flat plate made of conducive metal. The front end of the mating terminal 60 is located behind the front end of the tubular portion 52, and the rear end of the mating terminal 60 is connected to an unillustrated internal wiring disposed inside the case C.

As shown in FIG. 6, the resin wall 54 includes an insulating wall 55 disposed between two of the mating terminals 60 and a protection wall 56 surrounds the mating terminal 60 on three sides. One resin wall 54 is provided for one mating terminal 60 and two of the resin walls 54 are provided in FIG. 6. Thus, the insulating wall 55 is common to the two resin walls 54. Similar to the mating terminals 60, the insulating wall 55 is a flat plate long in a vertical direction, and slightly longer than the mating terminals 60 in the vertical direction while being slightly thicker than the mating terminals 60 in a plate thickness direction. On the other hand, the protection wall 56 has a substantially U-shape open toward the insulating wall 55. Although the protection wall 56 and the insulating wall 55 are not coupled, these walls are disposed to surround the mating terminal 60 on four sides and open forward.

As shown in FIG. 3, the front end of the tubular portion 52, the front end of the insulating wall 55 and the front ends of the protection walls 56 are disposed at the same position in a front-rear direction. Thus, the front ends of the mating terminals 60 are located behind the front ends of the resin walls 54. The mating terminals 60 are arranged in this way to prevent a finger from touching the mating terminal 60 when the finger is inserted into the inside of the resin wall 54. In other words, a distance between the front end of the mating terminal 60 and the front end of the resin wall 54 is longer than an insertion length of the finger. The insertion length of the finger becomes shorter as a distance between the insulating wall 55 and the protection wall 56 becomes shorter. Thus, to reduce a dimension of the mating connector 50 in a connecting direction, the distance between the insulating wall 55 and the protection wall 55 needs to be made as short as possible.

Figure 1:
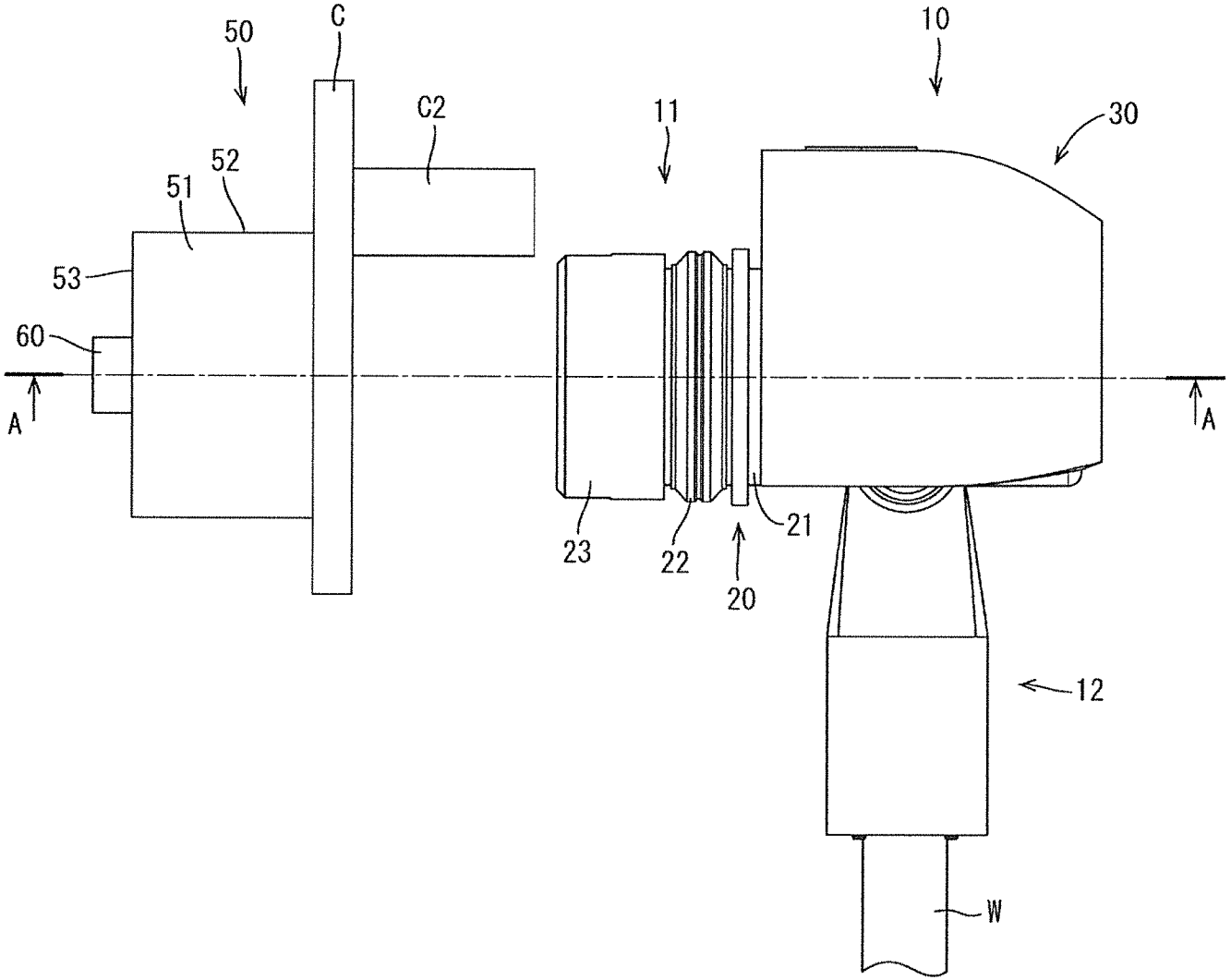
FIG. 1 is a side view showing a state before a connector and a mating connector in an embodiment are connected.
Figure 2:
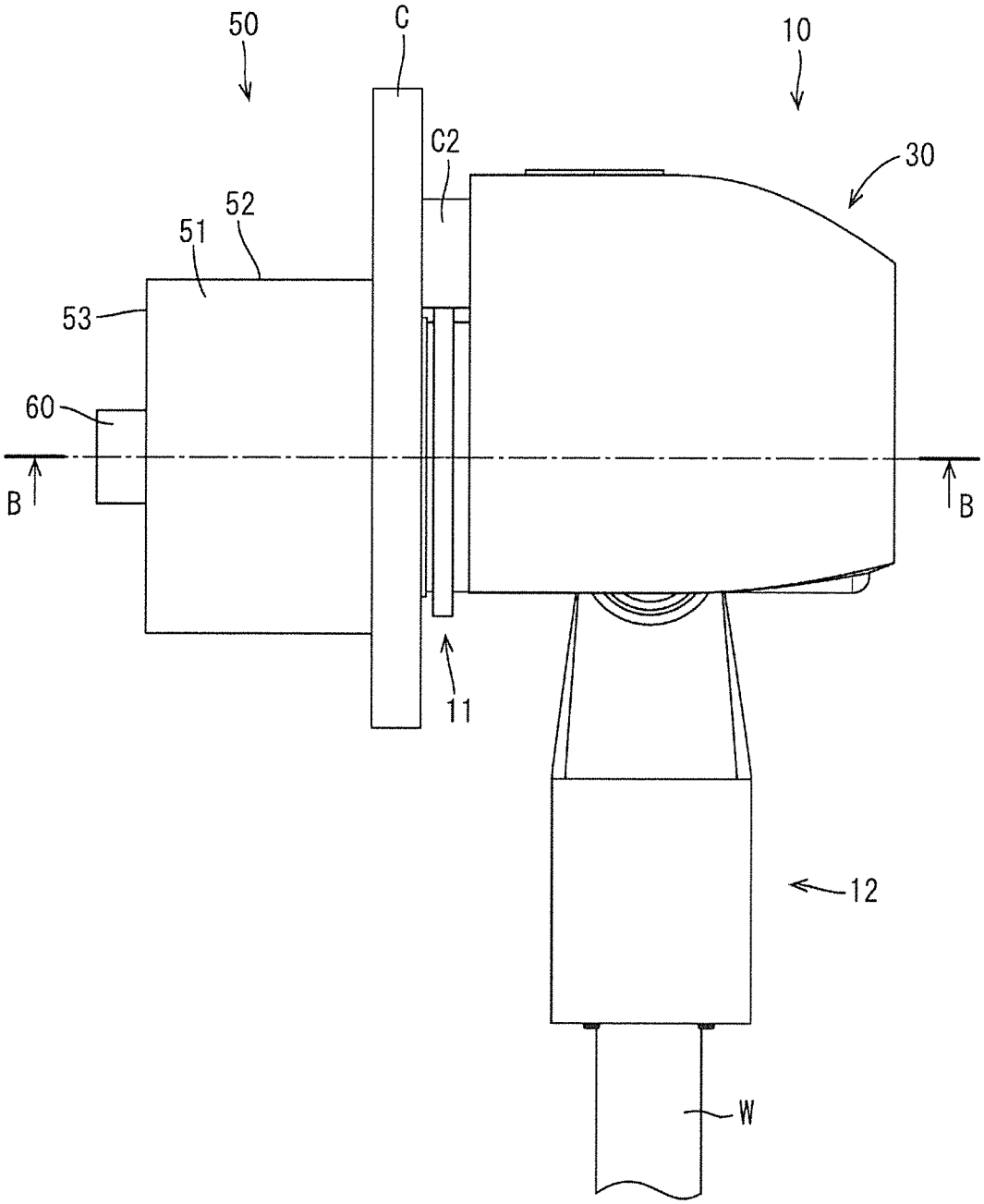
FIG. 2 is a side view showing a state after the connector and the mating connector are connected.

As shown in FIG. 1, the connector 10 includes a connector fitting 11 to be fit to the mating connector 50 and a wire pull-out portion 12 from which wires W are pulled out. The connector 50 is substantially L-shaped so that the connecting direction to the mating connector 50 and a pull-out direction of the wires W are perpendicular. As shown in FIG. 3, the connector fitting 11 includes a housing 20 made of synthetic resin, a shield shell 30 made of metal for covering the housing 20 and two terminals 40 to be connected to the two mating terminals 60.

The terminal 40 is made of conductive metal and includes a rectangular tube 41 into which the mating terminal 60 is fit, and a connecting plate 42 connected to and behind the rectangular tube 41. A braided wire 43 is fixed to the connecting plate 42 such as by welding, and the terminal 40 and a relay terminal 44 are connected via the braided wire 43. Although not shown, a core exposed at the end of the wire W is connected to the relay terminal 44. Thus, the terminal 40 and the wire W are connected conductively via the braided wire 43 and the relay terminal 44. Note that an unillustrated contact piece is provided inside the rectangular tube 41 and the terminal 40 and the mating terminal 60 are connected conductively by this contact piece resiliently contacting the mating terminal 60.

Figure 8:
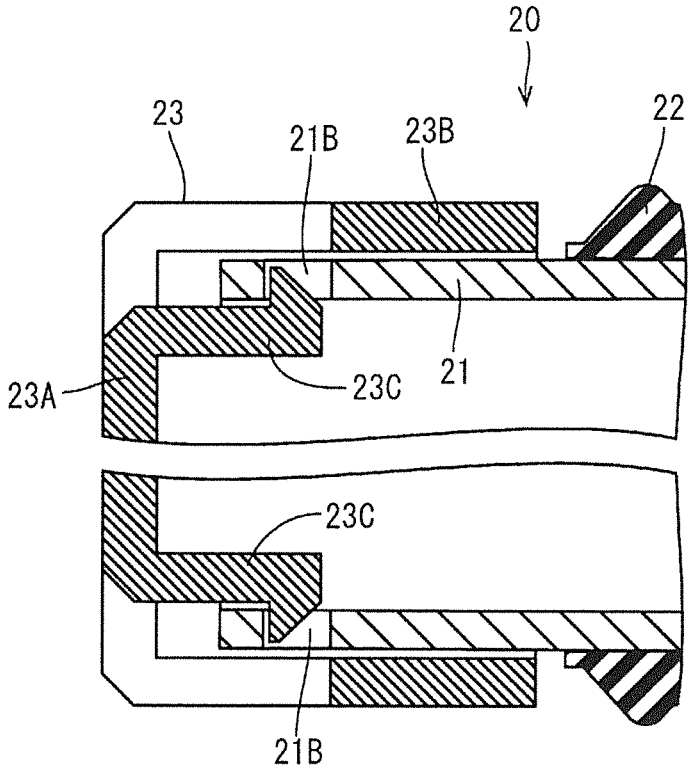
FIG. 8 is a partial enlarged section showing a locking structure of a front retainer.

The housing 20 includes an accommodating portion 21 for collectively accommodating the two terminals 40 inside, a rubber ring 22 fit on the accommodating portion 21 and a front retainer 23 for retaining the rubber ring 22 by being mounted before the rubber ring 22. The accommodating portion 21 has a hollow cylindrical shape and has an opening 21A open forward. The front retainer 23 includes a front wall 23A for closing the opening 21A and a peripheral wall 23B for allowing the front wall 23A to be mounted in a state movable with respect to the accommodating portion 21. As shown in FIG. 8, the front retainer 23 is mounted on the accommodating portion 21 by a lock piece 23C provided on the front wall 23A being fit into a lock hole 21B provided at the opening 21A from inside. Further, the front wall 23A is provided with two terminal insertion holes 24 through which the two mating terminals 60 are inserted.

As understood from FIG. 8, a predetermined clearance is set between the peripheral wall 23B of the front retainer 23 and the accommodating portion 21. Further, a predetermined clearance also is set between the opening 21A and the lock piece 23C. These two clearances are sufficiently smaller than an engagement margin between the lock piece 23C and the lock hole 21B. Thus, the front wall 23A of the front retainer 23 is mounted on the accommodating portion 21 while being enabled to move by a dimension equivalent to the smaller one of the above-described two clearances. A moving direction of the front wall 23A is perpendicular to the connecting direction of the connector 10 and the mating connector 50.

Figure 5:
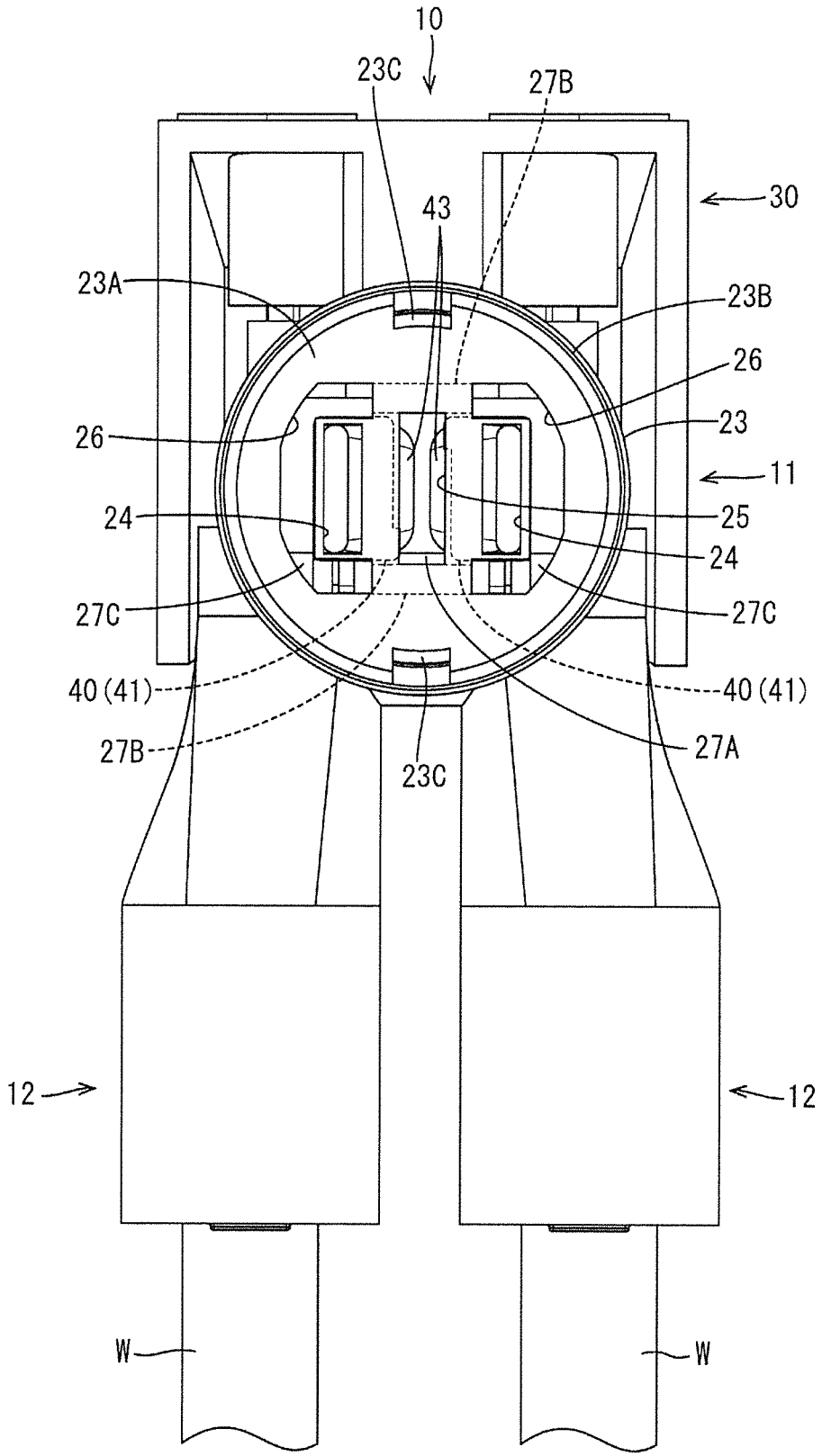
FIG. 5 is a front view of the connector.
Figure 7:
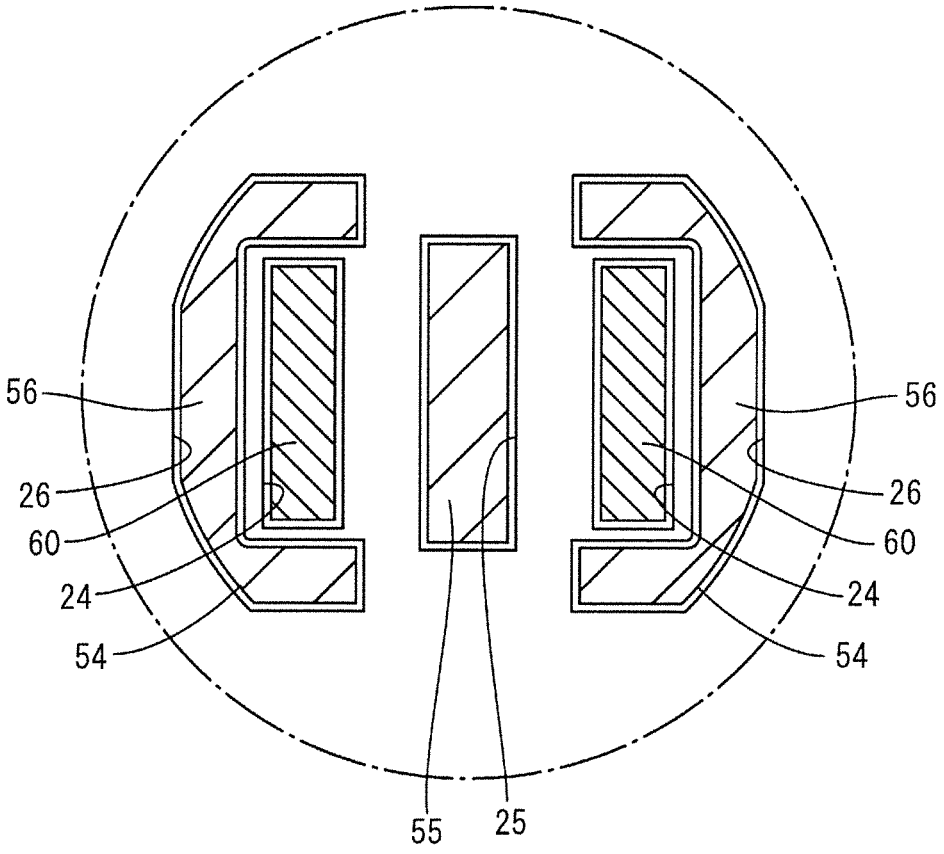
FIG. 7 is a section showing a state where resin walls are fit in insertion holes.

As shown in FIG. 5, the front wall 23A has a first insertion hole 25 through which the insulating wall 55 of the mating housing 51 is inserted and two second insertion holes 26 through which the two protection walls 56 are inserted. As shown in FIG. 7, a predetermined clearance is set between the insulating wall 55 and the inner wall of the first insertion hole 25 and predetermined clearances also are set between the two protection walls 56 and the inner walls of the two second insertion holes 26. FIG. 7 shows a case where the mating connector 50 is provided at a proper position. Even if the mating connector 50 is deviated in position with predetermined tolerances, the front wall 23A moves by the clearance so that a positional deviation can be absorbed.

Figure 9:
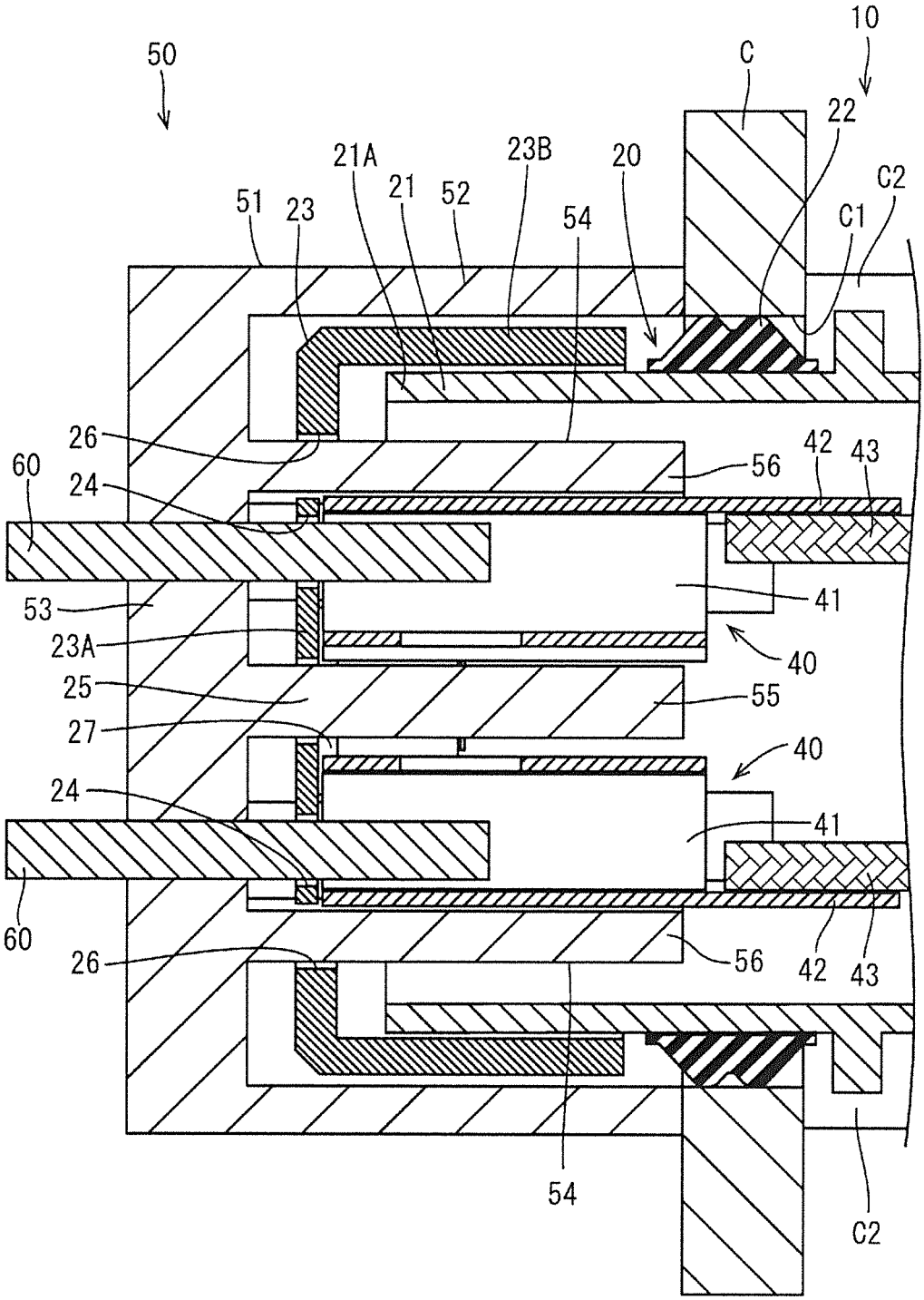
FIG. 9 is a partial enlarged section enlargedly showing the state after the connector and the mating connector are connected.

As shown in FIG. 9, a recess 27 is provided inside (side opposite to the back wall 53) of the front wall 23A for receiving front end parts of the terminals 40. The recess 27 has a depth that is about half the plate thickness of the front wall 23A. Ribs for temporarily holding the front end parts of the terminals 40 are provided around the recess 27. As shown in FIG. 5, the ribs are composed of a first rib 27A disposed between the two terminals 40, two second ribs 27B disposed at both upper and lower sides of the two terminals 40 and two third ribs 27C disposed at both left and right sides of the two terminals 40. Since these ribs 27A, 27B and 27C are provided at positions avoiding the first and second insertion holes 25, 26, the insulating wall 55 and the two protection walls 56 do not interfere with the respective ribs 27A, 27B and 27C when passing through the respective insertion holes 25, 26.

The terminal 40 is disposed between the first and third ribs 27A, 27C so that movements in a lateral direction are suppressed. Further, the terminal 40 is disposed between the upper and lower second ribs 27B so that movements in the vertical direction are suppressed. As just described, the terminals 40 are held temporarily in the front wall 23A by being surrounded on four sides by the respective ribs 27A, 27B and 27C. Further, the braided wire 43 is deflected to bias the terminals 40 forward as shown in FIG. 3. Thus, the front end parts of the terminals 40 are prevented from coming out rearward from the recess 27 by a biasing force of the braided wire 43. Furthermore, the braided wire 43 is flexible to an extent to be able to follow movements of the terminals 40. Therefore, the terminals 40 are movable while being positioned by the respective ribs 27A, 27B and 27C when the front wall 23A of the front retainer 23 moves in accordance with the position of the mating connector 50.

When the connector 10 and the mating connector 50 are connected from a state before connection shown in FIG. 3, the resin walls 54 first pass through the respective insertion holes 25, 26 to enter the housing 20. The front end parts of the terminals 40 are accommodated into the inside of the resin walls 54, and hence are positioned with respect to the resin walls 54. Thereafter, the mating terminals 60 that pass through the terminal insertion holes 24 and enter the housing 20 60 are connected to the terminals 40 in the positioned state. Therefore the terminals 40 and the mating terminals 60 are connected in proper postures.

When the connection of the connector 10 and the mating connector 50 is completed, as shown in FIG. 4, the terminals 40 and the mating terminals 60 are connected conductively to reach a state where the adjacent terminals 40 are insulated only by the insulating wall 55. Further, the rubber ring 22 is sandwiched between the inner peripheral surface of the mounting hole C1 and the outer peripheral surface of the accommodating portion 21. Thereafter, the two mounting portions C2 of the case C and the shield shells 30 are fixed by bolts so that the connector 10 and the mating connector 50 are held in a connected state and the shield shell 30 and the case C are shield-connected.

The insulating wall 55 and the protection walls 56 are disposed around the terminals 40. That is, in this embodiment, cavities for accommodating the terminals 40 are not present in the housing 20 and are configured only by the insulating wall 55 and the protection walls 56 provided in the mating housing 51. By doing so, the distance between the insulating wall 55 and the protection walls 56 can be set equal to or slightly larger than a dimension of the terminals 40. Thus, the distance between the insulating wall 55 and the protection walls 56 can be made shorter as compared to the case where the cavities for accommodating the terminals 40 are provided in the housing 20. Further, the finger insertion length into the inside of the resin walls 54 can be made shorter if the distance between the insulating wall 55 and the protection walls 56 can be made shorter. Thus, a length of the resin walls 54 in the connecting direction can be made shorter. In addition, if the length of the resin walls 54 in the connecting direction can be made shorter, the connection stroke of the connector 10 and the mating connector 50 can be made smaller.

As described above, the terminals 40 are positioned by the resin walls 54 provided in the mating connector 50. Therefore, it is not necessary to provide the housing 20 with a structure for positioning the terminals 40. As a result, the resin walls 54 not only position the terminals 40, but also insulate between the adjacent terminals 40. Thus, the housing can be miniaturized and, associated with this, the length of the resin walls 54 of the mating connector 50 in the direction perpendicular to the connecting direction can be made shorter. If the length in the direction perpendicular to the connecting direction is made shorter, the resin walls 54 can be made shorter in the connecting direction and the connection stroke to the mating connector 50 can be made smaller.

The housing 20 may include the accommodating portion 21 having the opening 21A that is open forward and that is configured to collectively accommodate the terminals 40 and the front retainer 23 to be mounted on the opening 21. The front retainer 23 may include the front wall 23A with the insertion holes 25, 26 through which the resin walls 54 are inserted, and the peripheral wall 23B for allowing the front wall 23A to be mounted in the state movable with respect to the accommodating portion 21. According to this configuration, the resin walls 54 are inserted through the insertion holes 25, 26 to enter the accommodating portion 21 and the terminals 40 are positioned by the resin walls 54. If the mating connector 50 is deviated in position with predetermined tolerances, a positional deviation can be absorbed by the front wall 23 moving in accordance with the position of the mating connector 50.

The front end parts of the terminals 40 may be held temporarily by the front wall 23A in the state closing the opening 21A. According to this configuration, the terminals 40 also simultaneously move when the front wall 23A moves. Thus, the resin walls 54 passed through the insertion holes 25, 26 cannot butt against the terminals 40.

The invention is not limited to the above described and illustrated embodiment. For example, the following modes are also included.

Although the mating connector 50 with the two resin walls 54 is illustrated in the above embodiment, a mating connector with three or more resin walls may be employed.

Although the insulating wall 55 common to the two resin walls 54 is illustrated in the above embodiment, one insulating wall may be provided for each resin wall.

Although the housing 20 with the separately configured accommodating portion 21 and front retainer 23 is illustrated in the above embodiment, a housing with integrally configured accommodating portion and front retainer may be employed.

LIST OF REFERENCE SIGNS

10 . . . connector
20 . . . housing
21 . . . accommodating portion
21A . . . opening
23 . . . front retainer
23A . . . front wall
23B . . . peripheral wall
25 . . . first insertion hole
26 . . . second insertion hole
40 . . . terminal
50 . . . mating connector
54 . . . resin wall
60 . . . mating terminal

The invention claimed is:

1. A connector connectable to a mating connector having a forwardly open tubular portion that includes a plurality of resin walls extending in a forward direction and having mating terminals extending in the forward direction individually fixed between adjacent ones of the plurality of resin walls, the connector comprising:

a housing having an accommodating portion with an opening facing the mating connector;

terminals accommodated in a movable state in the accommodating portion at positions corresponding to the mating terminals;

a front retainer mounted over the accommodating portion, the front retainer including at least one peripheral wall having an inner surface facing an outer surface of the accommodating portion and a front wall extending from the at least one peripheral wall in a direction substantially normal thereto to cover the opening of the accommodating portion, and a plurality of insertion openings formed in the front wall, each of the plurality of insertion openings configured for receiving one of the mating terminals or resin walls of the mating connector, wherein the connector is mounted in the tubular portion of the mating connector with the plurality of resin walls and mating terminals extending through the plurality of insertion holes in the front wall of the front retainer, and the terminals inserted between adjacent ones of the plurality of resin walls.

2. The connector of claim 1, wherein front end parts of the terminals are temporarily held by the front wall in a state closing the opening.

* * * * *